United States Patent [19]

Nishikawa

[11] 4,053,721

[45] Oct. 11, 1977

[54] PIEZOELECTRIC TYPE PICKUP CARTRIDGE FOR STEREO WITH PRESSING AND INTERMEDIATE MEMBERS FOR COUPLING

[75] Inventor: Kazuo Nishikawa, Tokorosawa, Japan

[73] Assignee: Pioneer Electronic Corporation, Tokyo, Japan

[21] Appl. No.: 659,064

[22] Filed: Feb. 18, 1976

[30] Foreign Application Priority Data

Feb. 18, 1975 Japan ..... 50-21545

[51] Int. Cl.[2] ..... H04R 1/16

[52] U.S. Cl. ..... 179/100.41 K; 179/100.41 P

[58] Field of Search ..... 179/100.41 K, 100.41 V, 179/100.41 T, 100.41 B, 100.41 P; 274/37

[56] References Cited

U.S. PATENT DOCUMENTS

| | | | |
|---|---|---|---|
| 3,055,989 | 9/1962 | Bachman | 179/100.41 K |
| 3,514,550 | 5/1970 | De Vries | 179/100.41 K |
| 3,673,354 | 6/1972 | Oda et al. | 179/100.41 V |
| 3,952,171 | 4/1976 | Dieter | 179/100.41 K |
| 3,975,025 | 8/1976 | Obata et al. | 179/100.41 K |

*Primary Examiner*—Raymond F. Cardillo, Jr.
*Attorney, Agent, or Firm*—Sughrue, Rothwell, Mion, Zinn and Macpeak

[57] ABSTRACT

A piezoelectric type pickup cartridge comprises a cantilever, an intermediate member deformable in two orthogonal directions, a press member secured to the other end of said cantilever and adapted to transmit the movement of the cantilever to the intermediate member, a piezoelectric transducing element, a damper provided between the element and the base for holding the piezoelectric element between the intermediate member and the damper.

7 Claims, 10 Drawing Figures

FIG 1
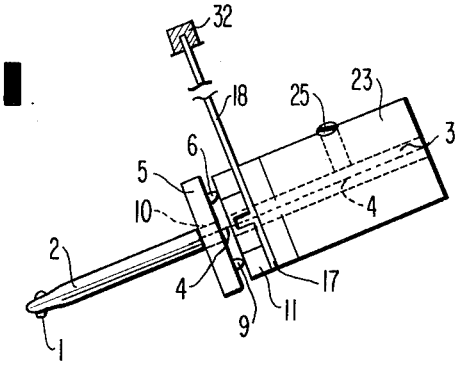
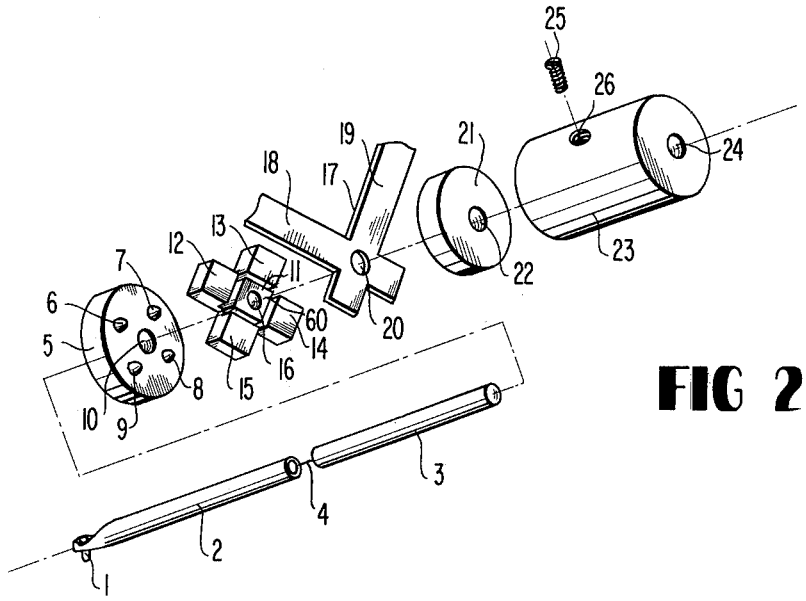
FIG 2
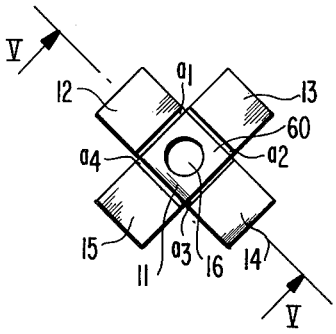
FIG 3
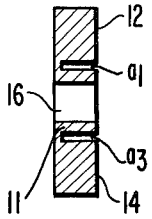
FIG 4
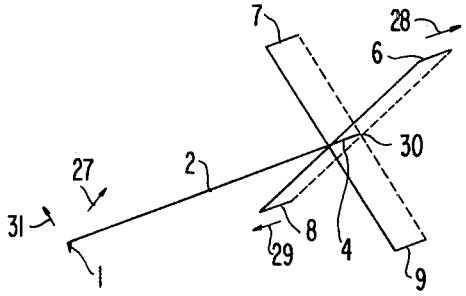
FIG 5

FIG 6
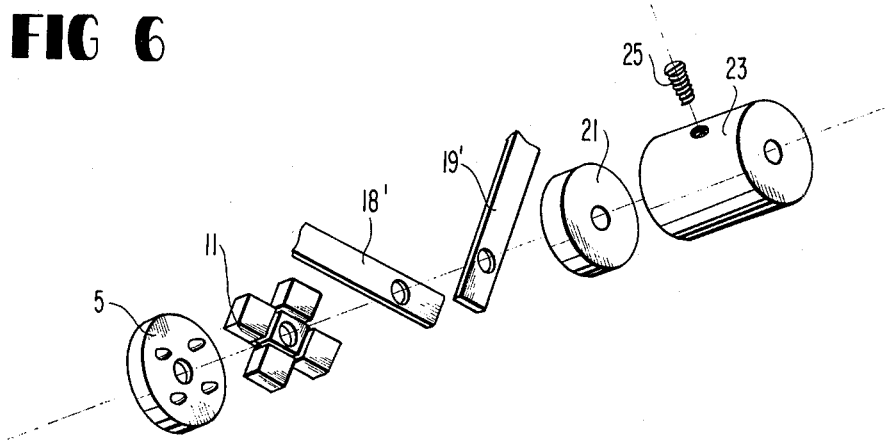
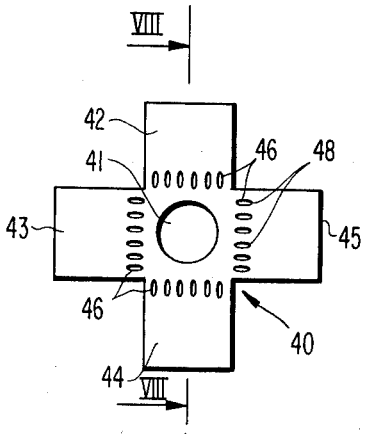
FIG 7
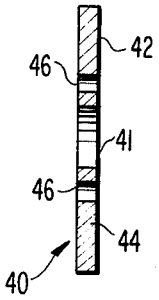
FIG 8
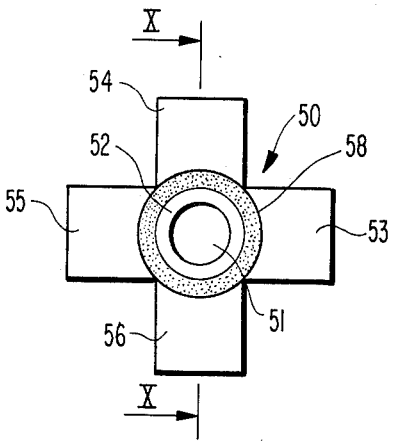
FIG 9
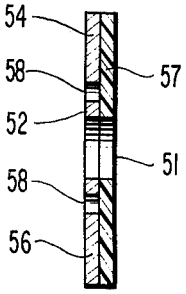
FIG 10

PIEZOELECTRIC TYPE PICKUP CARTRIDGE FOR STEREO WITH PRESSING AND INTERMEDIATE MEMBERS FOR COUPLING

BACKGROUND OF THE INVENTION

1. Field of the Invention

This invention relates to piezoelectric type pickup cartridges.

2. Description of the Prior Art

It has been known for some time that piezoelectric elements may be used as the transducing medium in pick up cartridges such as used in stereophonic systems for playing recorded discs. The older systems used relatively brittle elements such as a Rochelle salt crystal or a porcelain substance, like barium titanate. These piezoelectric elements were made thick to compensate for their brittleness, but the thickness reduced the responsiveness of the piezoelectric to vibrations of the stylus.

Several developments have enabled the construction of piezoelectric pick up cartridges with thin piezoelectric elements. One development is the semiconductor thin film peizoelectric pick-up cartridge of the type shown in Oda et al U.S. Pat. No. 3,673,354. The other development is the high polymer piezoelectric pick up cartridge which uses as the piezoelectric element a flexible high polymer material such as polyvinylidene fluoride resin film. In the latter type of cartridges the best results can be achieved if the high polymer material can be subjected to bending torques in response to stylus vibration, while at the same time being free from local deformation at the interface between the piezoelectric element and the pressing member which presses on the piezoelectric element. However the prior art designs result in a very small contact area between the pressing member and the piezoelectric element. Examples are found in the Oda et al patent, mentioned previously, and in de Vries et al U.S. Pat. No. 3,514,550. Such designs, when used with high polymer piezoelectric elements can result in local deformations at the points of contact, which deformations prevent faithful reproduction of sound recorded on the disc in the form of vibrations. This same problem is applicable to all thin flexible piezoelectric elements.

SUMMARY OF THE INVENTION

It is therefore a main object of the present invention to provide an improved piezoelectric type pick up cartridge of the type using a thin, flexible piezoelectric transducing element, such as high molecular materials, semiconductor materials, or the like.

Another object of the present invention is to provide an intermediate member for faithfully transmitting vibrations of a stylus to a piezoelectric element.

These and other objects are achieved by providing a design for a cartridge wherein an intermediate member is placed between a pressing member and the piezoelectric element. The pressing member is mounted so as to vibrate about a fixed fulcrum along with the stylus and cantilever. The intermediate plate is fixed at a support portion thereof at a position which is the position of the fulcrum. The intermediate member has laterally extending flat wing members which pivot about the line of joinder with the support portion. One face of each said wing member abuts a projection on the pressing member. The opposite face of each wing member forms a relatively large contact interface with the piezoelectric element.

BRIEF DESCRIPTION OF THE DRAWINGS

FIG. 1 is a side view showing the structure of a pick-up cartridge of the present invention, FIG. 2 is an exploded perspective view showing respective parts of the embodiment shown in FIG. 1, FIG. 3 is a rear elevation of an intermediate member shown in FIGS. 1 and 2, FIG. 4 is a cross-sectional view taken in the direction of V—V in FIG. 3, FIG. 5 is a perspective view showing the operation of abutments of a press member shown in FIGS. 1 and 2, FIG. 6 is an exploded perspective view showing respective part of a cartridge using two unidirectional piezoelectric elements.

FIG. 7 is rear elevation showing another embodiment of an intermediate member, FIG. 8 is a side view of FIG. 6, FIG. 9 is a rear elevation showing a further embodiment of an intermediate member, and FIG. 10 is a side view of FIG. 8.

DESCRIPTION OF THE PREFERRED EMBODIMENT

Referring to the attached drawings, in FIGS. 1 and 2, numeral 2 denotes a cantilever having a stylus 1 at its one end. The opposite ends of a wire 4 are connected to the cantilever 2 and a fixed bar 3, respectively. A press member 5 has a central hole 10 and abutments 6, 7, 8 and 9 each of which is disposed at such position on the face of the press member that it occupies a corner of a square having its center coincident with the center of central hole 10. The press member 5 is secured at its central hole portion 10 to the end of the cantilever 2 opposite stylus 1. An intermediate member 11 is provided with a support portion 60, having a central hole 16 therein, and plates or wings 12, 13, 14 and 15 which can be bent about pivot points or lines $a_1$, $a_2$, $a_3$ and $a_4$, shown in FIGS. 3 and 4.

A piezoelectric transducing element 17 consisting of thin and flexible high molecular piezoelectric material, such as, for example, a polyvinylidene fluoride resin film, has a central hole 20, thru which fixed bar 3 tightly fits for support purposes, and generating portions 18, 19 for generating electric signals when bent, as is well known. The generating portions 18 and 19 are constituted so as to intersect each other at a right angle. A damper 21 consisting of an elastic material, such as rubber, is provided with a hole 22 through which the fixed bar 3 is inserted. A base member 23 has a hole 24 for inserting the fixed bar 3 as well as a screw hole 26 for securing the bar 3 with a screw 25.

The end face of the fixed bar 3 nearest the cantilever 2 is positioned nearly on the end face of the intermediate member 11 which contacts with the abutments of the press member 5, thereby stabilizing the vibration fulcrum of the cantilever 2. And, accordingly, the movement of the cantilever may be transmitted faithfully to the piezoelectric member 17. As a result of the intermediate member 11 being supported fixedly on bar 3, the support portion 60 of the intermediate member 11 is held stationary.

In assembling the cartridge, the end of the cantilever 2 is inserted into and secured to the press member 5, and then the fixed bar 3 is inserted into, in turn, a hole 16 of the intermediate member, a hole 20 of the piezoelectric element 17, a hole 22 of the damper 21 and a hole 24 of the base 23. The intermediate member 11 and the piezoelectric element 17 are secured to the fixed bar 3 so as to be squeezed between the abutments 6, 7, 8 and 9 of the press member 5 and the damper 21. The fixed bar 3 is secured to the base 23 by means of the screw 25. Further, the other free ends of generating portions 18 and 19 of the piezoelectric element 17 are held fixed to a stylus pick-up piece 32 as shown in FIG. 1. The electrical circuitry for picking up the electrical signals is conventional and therefore not shown.

Although the piezoelectric transducing element 17 in FIG. 2 is a bidirectional element having two generating portions 18 and 19 intersecting each other at right angles, a pair of undirectional transducing elements 18' and 19', as shown in FIG. 6, may be substituted therefor. Because of the extreme thinness of the thin film, for example, $7\mu - 30\ \mu$, the elements can be easily produced.

Referring to FIG. 5, when the stylus moves in the direction indicated by the arrow 27, the cantilever 2 pivots clockwise about a fulcrum point 30, which coincides with the attachment of wire 4 to fixed bar 3. This causes the projection points 6 and 8 to move in the directions of arrows 28 and 29 respectively. Consequently the deformable plate portions or wings 12 and 14 of intermediate member 11 pivot clockwise about the central support portion 60 of member 11 without moving the remaining wings 13 and 15. This deformation, or more accurately, this bending, is transferred by the intermediate member to part 18 of piezoelectric element 17, which in-turn is converted into an electric signal as is well known. The presence of the intermediate member 11 and the damper 21 insure that the parts pressing on the piezoelectric do not come into and out of contact with the piezoelectric as is the case with the prior art. Also, the contact area between the wings 12 – 15 and piezoelectric element 17 are relatively large. This feature thereby removes the drawback of the prior art where the local deformations caused when the piezoelectric element is contacted at a small contact area thereby preventing faithful conversion of the stylus vibration.

On the other hand, when the stylus 1 moves in the direction of the arrow 31, the portion 19 of the piezoelectric element 17 moves in the counter-clockwise direction in the same way as described above. Consequently, the displacement of generating portions 18 and 19 of the piezoelectric element 17 results in voltage variations of two channels at electrodes (not shown), thereby carrying out stereophonic reproduction.

Moreover, in the above embodiment, though four abutments are provided on the press member, the device will operate with only two abutments 6 and 7.

FIGS. 7 and 8 show another embodiment of the intermediate member used in the present invention. In this embodiment, a cross-shaped intermediate member 40 is composed of a metal plate being provided with a hole 41 thru support portion 48, and a plurality of laterally extending plate portions or wings 42 – 45. At the point of joinder of each wing and the support portion 48 there are a plurality of holes or perforations 46 which permit the wings 42 – 45 to be bent about the support 48 acting as a pivot point. For this type of construction, deformation resistance may be easily and optionally designed by changing the size and the number of the holes 46. Further, the intermediate member 40 may be made of a metal plate which may be thinner than a synthetic resin film. Therefore, the vibration of the cantilever can be faithfully transferred to the peizoelectric element 17. Also, by means of an etching technique, high quality intermediate members 40 can be easily obtained.

FIGS. 9 and 10 show a further embodiment of the intermediate member of the present invention. In this embodiment, the intermediate member 50 is so constructed that the front surface of the member is made of a un-deformable metal plate and on the back surface thereof a thin rubber or a synthetic resin film 57 is adhered. An annular aperature between projections 53, 54, 55, 56 and annular part 52 may be etched away to permit easy bending in response to vibration of the stylus. And, it may be effective that the intermediate member 50 is constructed so as to contact the portion of rubber or thin synthetic resin film 57 with the piezoelectric element 17. With this construction, as the abutments 6, 7, 8 and 9 are contacted with the un-deformable metal plate, local deformation does not occur. Further, since the intermediate member 50 is constructed by differend kinds of materials, the occurence of co-oscilation of the intermediate member can be prevented. In the case of the intermediate plate 50, the support portion comprises the annular metal ring 52 and the portion of backing 57 which is adhered to the annular ring 52. It will be noted that the annular aperture 58 is formed by etching after adhering the metal plate to the backing 57.

What is claimed is

1. A piezoelectric type pick-up cartridge comprising a cantilever having one end mounting a stylus and the other end connected to a base member by a wire, an intermediate member deformable in two orthogonal directions mounted on said base member adjacent the point of connection of said base member and said wire, a press plate means secured to the other end of said cantilever and in contact with said intermediate member for transmitting the movement of said cantilever to said intermediate member, a piezoelectric transducing means for generating electric signals in response to the deformations thereof mounted on said base member and positioned to abut the intermediate member on a side thereof opposite to the side of said intermediate member which contacts said press plate means, a damper means mounted on said base member and on said piezoelectric transducing element, said piezoelectric transducing element being tightly positioned between said damper means and said intermediate member, whereby vibration of said stylus is transferred to said piezoelectric element via said cantilever, said press member and said intermediate member.

2. A piezoelectric type pick-up cartridge as claimed in claim 1 wherein said intermediate member is a cross shaped plate having a central support portion fixed to said base member and four wing portions laterally extending orthogonally outwardly from said support portion and interconnected with said support portion to permit said wing portions to pivot about the points of interconnection.

3. A piezoelectric pick-up cartridge as claimed in claim 2 wherein said intermediate member comprises a first metal plate having a cross shape and a flexible elastic backing material of cross-shape adhered to said metal plate, said combination of metal plate and backing defining a central aperature therein for permitting said intermediate member to fit on said base member, and said metal plate having an annular opening therein at the interconnection points of said wing portions and said support portions.

4. A piezoelectric type pick-up cartridge as claimed in claim 2 wherein said cross shaped plate has troughs at the interconnections of said wing portions and said support portions.

5. A piezoelectric pick-up cartridge as claimed in claim 4 wherein said intermediate member is a single metal plate.

6. A piezoelectric type pick-up cartridge as claimed in claim 2 wherein said cross shaped plate has perforations at the interconnections of said wing portions and said support portions.

7. A piezoelectric pick-up cartridge as claimed in claim 6 wherein said intermediate member is a single metal plate.

* * * * *